United States Patent [19]

Howard et al.

[11] Patent Number: 4,458,141

[45] Date of Patent: Jul. 3, 1984

[54] ELECTRIC HEATER AND COIL SUPPORT INSULATOR THEREFOR

[75] Inventors: H. Keith Howard; Jimmy L. Skerrill, both of Cookeville, Tenn.

[73] Assignee: Tutco, Inc., Cookeville, Tenn.

[21] Appl. No.: 206,899

[22] Filed: Nov. 14, 1980

[51] Int. Cl.[3] ..... H05B 3/06

[52] U.S. Cl. ..... 219/532; D13/18; 174/138 J; 174/149 R; 174/175; 219/537; 219/542; 219/548; 338/304

[58] Field of Search ..... 219/377, 532, 536, 537, 219/546, 548, 550, 374, 375, 381, 542; 174/138 J, 149 R, 175 A, 138 G, 158 R, 212; 338/282, 304, 299, 315-321; D13/17, 18

[56] References Cited

U.S. PATENT DOCUMENTS

| | | | |
|---|---|---|---|
| D. 261,260 | 10/1981 | Seeley | D13/18 |
| D. 262,285 | 12/1981 | Janning | D13/18 |
| 1,188,972 | 6/1916 | Moffat | 174/138 J |
| 1,695,801 | 12/1928 | Dibble | 219/532 |
| 1,698,282 | 1/1929 | Simmons | 219/532 X |
| 1,712,860 | 5/1929 | Weimar | 174/149 R |
| 2,177,930 | 10/1939 | McKeown | 338/304 |
| 2,856,500 | 10/1958 | Hartman | 174/138 J X |
| 3,218,437 | 11/1965 | Laing | 338/282 X |
| 3,358,074 | 12/1967 | Himes | 174/138 J |
| 3,632,981 | 1/1972 | Gasparaitis | 219/377 |
| 3,846,619 | 11/1974 | Wightman et al. | 219/532 |
| 3,884,442 | 5/1975 | Breeden et al. | 174/149 R X |
| 3,890,487 | 6/1975 | Wightman et al. | 219/532 |
| 4,250,399 | 2/1981 | King | 219/532 |
| 4,268,742 | 5/1981 | Cottrell et al. | 219/532 |

FOREIGN PATENT DOCUMENTS

| | | | |
|---|---|---|---|
| 554732 | 3/1958 | Canada | 219/532 |
| 422800 | 1/1935 | United Kingdom . | |
| 615613 | 1/1949 | United Kingdom . | |
| 684262 | 12/1952 | United Kingdom . | |
| 1482286 | 8/1977 | United Kingdom . | |

*Primary Examiner*—Volodymyr Y. Mayewsky
*Attorney, Agent, or Firm*—Berman, Aisenberg & Platt

[57] ABSTRACT

An electric heater incorporating simple support structure therefor. A frame is insulated from an electric resistance heater coil by insulated supports mounted within beam members of the frame. The supports incorporate structural features enabling the use of simplified supporting beams. The support insulators include additional structural features for retaining the resistance wire in place and for simplified engagement therewith. The insulators may project on both sides of the support beams and retain heater wires in two planes. The support insulators further provide an integrated structure easily fabricated and simply assembled to the frame.

12 Claims, 13 Drawing Figures

FIG. 4
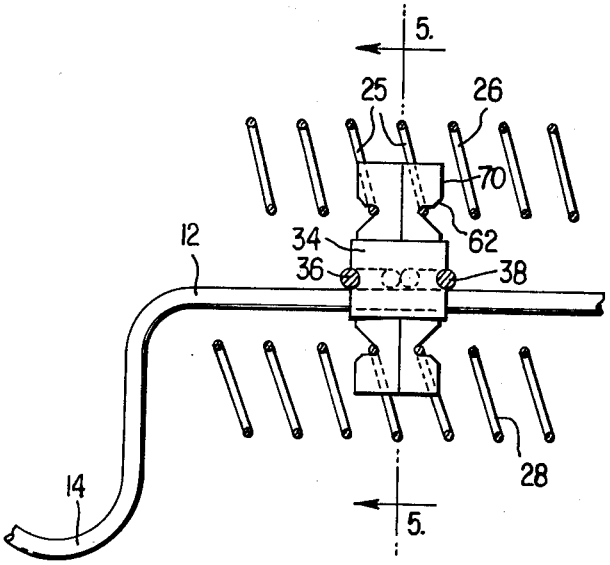
FIG. 5
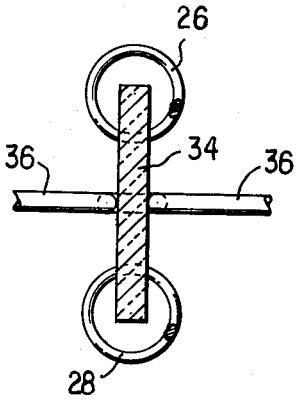
FIG. 6
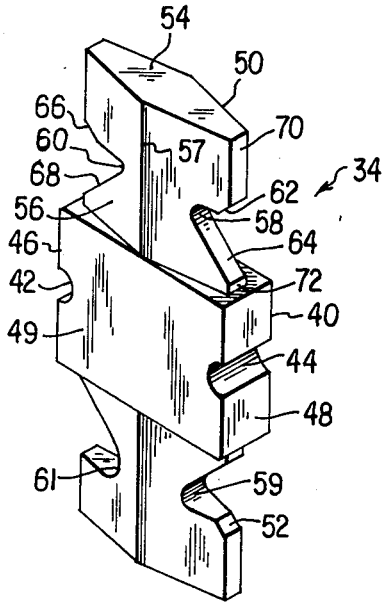
FIG. 7
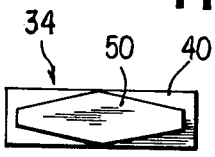
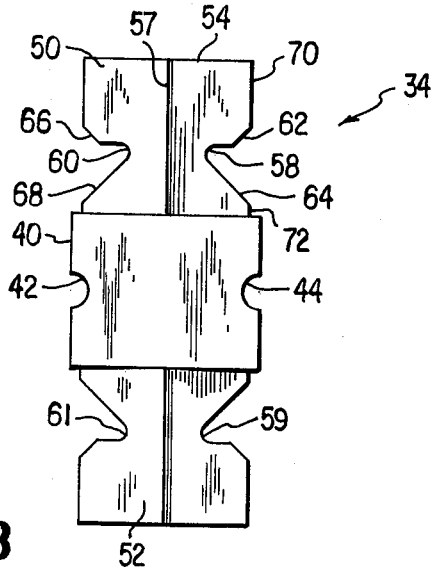
FIG. 8

FIG. 9
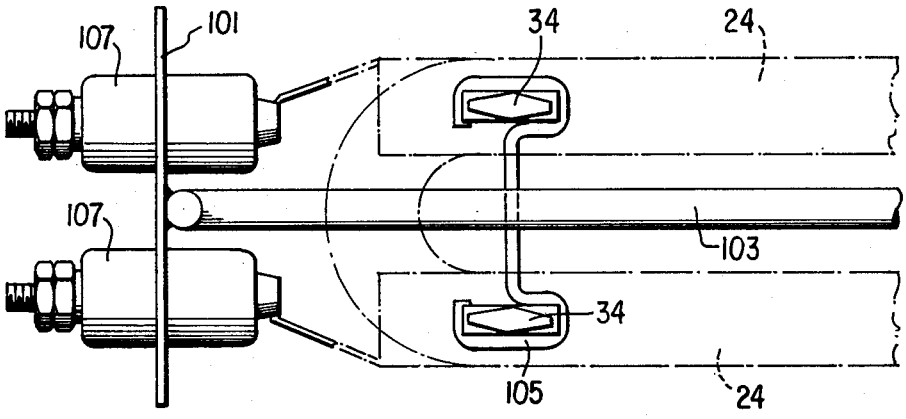
FIG. 10
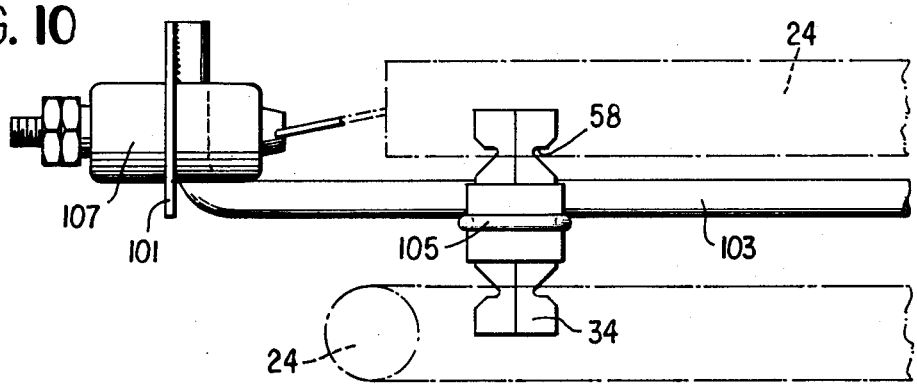
FIG. 11
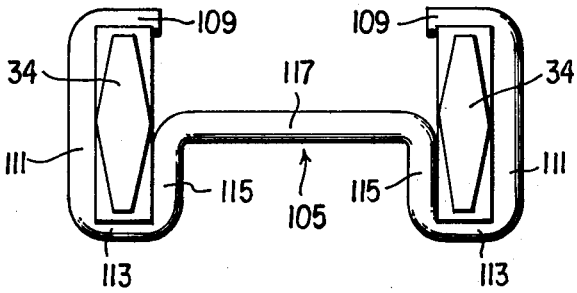
FIG. 13
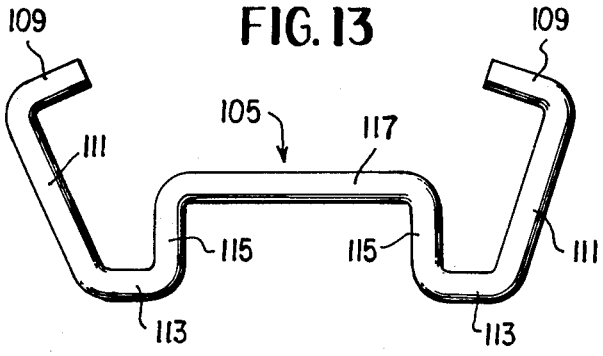
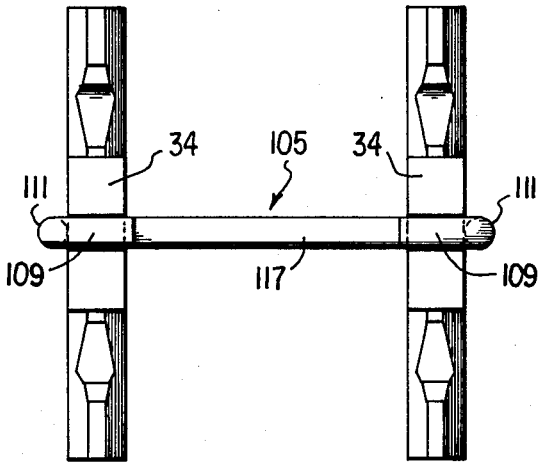
FIG. 12

ELECTRIC HEATER AND COIL SUPPORT INSULATOR THEREFOR

BACKGROUND OF THE INVENTION

1. Field of the Invention

This invention relates to electric heaters, and more particularly to such heaters utilizing support insulators for retaining and securing electric heater coils therein.

2. Description of the Prior Art

Electric heaters, utilizing resistance wire supported in a frame are known in the art. Such heaters, typically called open-coil heaters, require the use of insulators to separate the resistance wire from the frame structure and to avoid the possibility of a short circuit between the resistance wire and the frame. Heaters of this type similarly require the use of means for retaining the resistance wire in a predetermined, desired configuration with respect to the frame.

Prior art devices are known which attempt to provide insulators including coil holders for retaining a heater coil and insulating the same from the heater framework. Wightman et al., U.S. Pat. No. 3,846,619 discloses the use of insulator means mounted on cross beams of a heater frame for supporting a helical heater wire. Clip means are required to be attached to the insulators, however, in order to properly support the heater coil. The clips need to be specially formed with flange surfaces bent in non-planar configurations to retain the heater wire. Moreover, insertion of a convolution of the coil within the clip is made difficult, and removal of the coil, which might be required for maintenance or repair, is extremely difficult. The cross beams of the framework require a particular structure, and incorporate tabs to interact with portions of the insulator body to retain the insulator therein. Similarly, tabs are required on the clip means to secure the same on the insulators. In summary, a structure is disclosed in the reference, requiring a number of complicated steps eliminated by the present invention. Specifically, the presently disclosed structure embodies a unified insulator support which may be easily mounted in the cross beams of a frame. The mounting process utilizes a first set of notches in the insulator structure, while the coil is secured by a second set of notches. Tabs are not required, and assembly of the device is simplified.

Simmons, U.S. Pat. No. 1,698,282, similarly discloses an electric heater incorporating insulators, or supports, which require special manipulation for mounting on the cross beams. Additionally, each support structure requires the use of two insulator elements. Simultaneous manipulation of the two elements is required in a 90° rotation for mounting the support structure, and a complicated manipulation of several combined support structures is required for the removal of a single damaged support. Moreover, the use of cotter pins is mandated in order to secure the supports against displacement. Unlike the Wightman et al. disclosure, the supports in Simmons cannot protrude through the cross beams, and thus may support a heater coil on only one side of the frame.

Hartman, U.S. Pat. No. 2,856,500, discloses a single integral insulator for an electrical heater which is mounted to a reflector in the heater. The reflector includes a plurality of key openings for receiving key-like projections from the insulator. The projections are narrower than the body of the insulator, and disposed on opposite sides of the body with respect to the heater coil support means. Accordingly, the possibility of providing a single support structure capable of supporting electric wire on both sides of a support beam is precluded by the disclosed structure. As in Wightman et al., tabs are required to be manufactured in the support beams for the insulators, and as in Simmons, special rotational steps are needed for mounting the insulators on the heater reflector.

Other teachings of insulators and spacers used in conjunction with electric heaters include McKeown U.S. Pat. No. 2,177,930; Gasparaitis, U.S. Pat. No. 3,632,981 and Laing, U.S. Pat. No. 3,218,437. Weimar, U.S. Pat. No. 1,712,860 discloses the use of two insulators above and below a cross arm of a telephone, electric or telegraph pole, the insulators having an annular groove for the wire.

It is accordingly seen that none of the prior art references disclose, either singly or in combination, an easily fabricated, easily assembled and simplified structure for supporting resistance wire in electric heaters. The present invention provides an insulated supporter, for an electric heater, which is integrally formed and is substantially symmetric. These features permit insertion of the insulator within the support beam structure of an electric heater with a terminal orienting and aligning effort, and further permit straightforward assembly of the heater wire to the frame by simplified attachment to the insulator.

Mounting of the insulators to the support beams is accomplished by insertion into a cavity, a snapping or clipping action taking place between the beam structure and notches on the insulators. A second set of notches provides a similar snap-fit for the resistance heater wire mounted on the support insulators.

SUMMARY AND OBJECTS OF THE INVENTION

The present invention overcomes the deficiencies of the prior art and provides an electric heater having a framework for supporting a resistance heater wire, the framework including support beams for a plurality of support insulators. The support beams may be comprised of one or more metal rods, the rod or rods being bent at predetermined locations to form cavities for accepting the insulators. The insulators of the present invention are inserted into the cavities and locked in place by the rods which fit a pair of notches on each insulator. A second set of notches, substantially coplanar with the first set, accepts at least a single convolution of the helical heater wire. The heater wire is retained in place by the spring action of its coils and the width of the ceramic shoulders, acting in cooperation with the second set of notches. The pair of shoulders on the insulators extend beyond the coil convolution to prevent transverse movement of the coil, while axial displacement is prevented by the body of the insulator.

It is accordingly an object of the invention to provide an easily manufactured electric heater having an open heater coil structure.

It is another object of the invention to provide an easily fabricated support insulator for use in an electric heater.

It is still another object of the invention to provide an electric heater having a longitudinal frame with transverse cross beams, wherein the cross beams are easily manufactured.

It is yet another object of the invention to provide an electric heater having support insulators insertable into cavities within support beams of its framework, the cavities having a shape matching the cross section of the insulators and preventing rotational movement of the insulators therein.

It is an additional object of the invention to provide an electric heater wherein support insulators are inserted in cavities formed in support beams, the depth of insertion being determined by cooperation between the support beam structure and support insulator structure. A further object of the present invention is to provide a support beam for retaining the insulators in place by a clipping action.

Still a further object of the invention is the provision of integrated support insulators for an electric heater, the insulators having first and second mounting means therein, the first and second mounting means comprising notches situated substantially in a single plane.

Yet another object of the invention is the provision of integrated support insulators for an electric heater, the insulators having a first set of notches for mounting to a support beam of said heater, a second set of notches for accepting and retaining a heater wire disposed on one side of the support beam, and a third set of notches for accepting and retaining a heater wire disposed adjacent the opposite side of the support beam.

The present invention also provides an electric heater having a framework for supporting a resistance heater wire, the framework including a longitudinal elongated structural member supporting a plurality of gripping members securing support insulators. The support insulators preferably have a first pair of notches oppositely disposed on either longitudinal end of the insulator with the gripping member having a first and second portion releasably fitting in the notches of the support insulators. The gripping member preferably grips a pair of support insulators and is attached to the elongated structural member with the insulators symmetrically disposed about the elongated structural member. A second set of notches, substantially coplanar with the first set, accepts a single convolution in the helical heater wire. The heater wire is retained in place by the spring action of the coils, acting in cooperation with the second set of notches. A pair of shoulders bordering the second set of notches on the support insulators extends beyond the coil convolution to prevent transverse movement of the coil, while axial displacement is prevented by the body of the insulator.

These and other objects, features and advantages of the present invention will become apparent from the following specification and appended claims when considered in conjunction with the attached drawing.

BRIEF DESCRIPTION OF THE DRAWING

FIG. 4 is an elevational view of a support insulator of the present invention as used in the heater of FIG. 2 and viewed along line 4—4 therein;

FIG. 5 is an edge view of the support insulator of the invention as used in the heater of FIG. 4, taken along line 5—5 therein;

FIG. 6 is a perspective view of a support insulator in accordance with the present invention;

FIG. 7 is a plan view of a support insulator of the present invention;

FIG. 8 is an elevational view of a support insulator of the present invention;

FIG. 9 is a plan view of an electric heater containing a second embodiment of the present invention;

FIG. 10 is a side elevation of an electric heater containing the second embodiment of the present invention;

FIG. 11 is a plan view of the support insulators of the second embodiment of the present invention;

FIG. 12 is an end view of the support insulators of the second embodiment of the present invention; and FIG. 13 is a plan view of the gripping member in the second embodiment of the invention seen in the process of bending.

DETAILED DESCRIPTION OF THE PREFERRED EMBODIMENT

Figure 1:
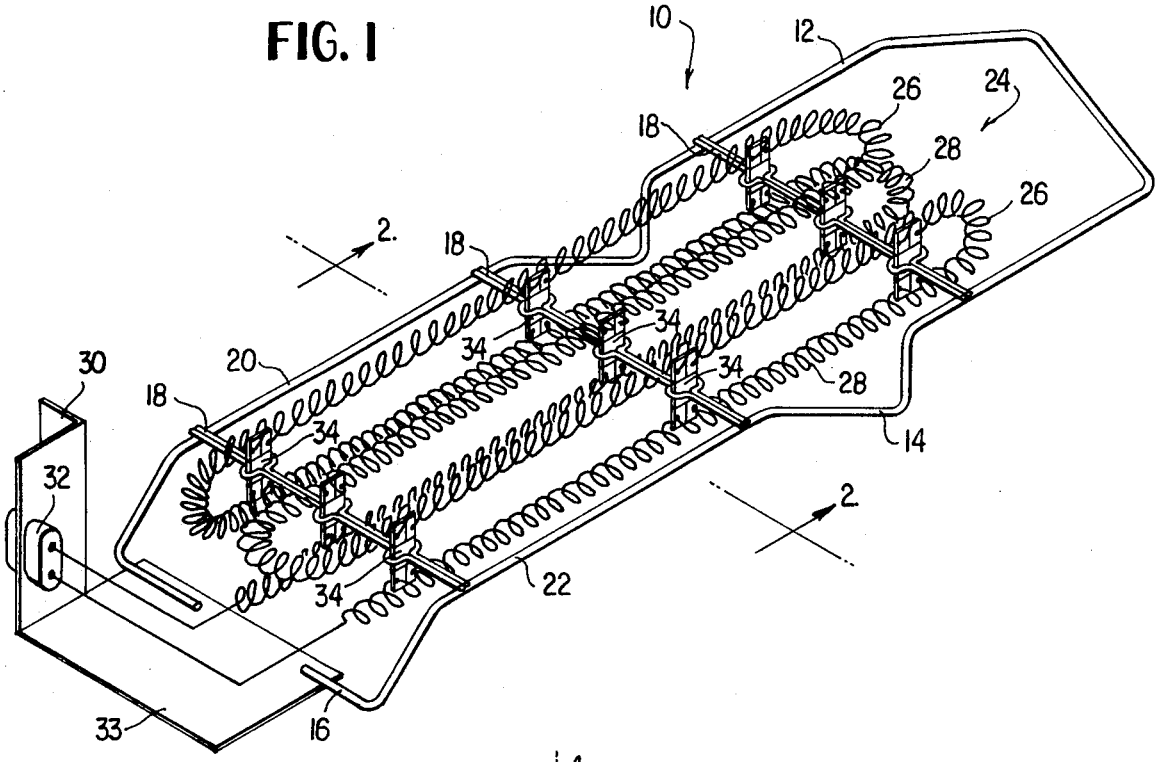
FIG. 1 is a perspective view of an electric heater embodying the present invention.
Figure 2:
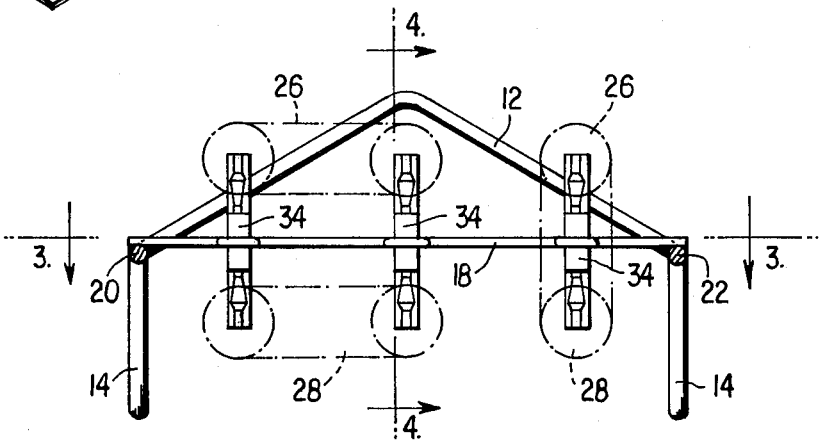
FIG. 2 is an elevational view of the electric heater of FIG. 1 taken along line 2—2 therein.

Referring now to FIG. 1, a first embodiment of an electric heater incorporating the present invention is generally shown at 10. As is seen in the figure, the heater includes a frame 12, the frame including leg supports 14 and 16 for spacing the heater from a horizontal support surface (not shown) upon which it may rest. The frame further includes structural members 18, shown as elongated beams connecting side members 20 and 22 of the frame.

The first embodiment of the present invention utilizes an electrical resistance heater wire, shown at 24, coiled along an axis as is known in the art. The heater coil includes a plurality of convolutions, typically forming a helical structure, providing a spring-like appearance to the wire and adding a spring-like resilience to the wire in the axial direction of the coil. The heater coil must be spaced apart from the frame members, including beams 18, to avoid the occurrence of electrical short circuits. The longitudinal axis of the coil is preferably oriented transversely to the structural members 18 to avoid interference by members 18 with the heat radiation pattern of the coil as well as to provide support for a maximal heater area with a minimal number of structural members 18.

The heater coil may comprise two segments 26 and 28, above and below the plane of structural beam members 18 respectively. The segments may both be portions of the same coil, as shown in FIG. 1, or may be two distinct and separate coils.

The present heater is shown as including a faceplate structure 30, which includes therein a means 32 for providing electrical current to the heater coil. The faceplate and electrical contact are shown connected to frame 12 by a connecting means 33. It is appreciated that the entire assembly may be enclosed in an enclosure, and that faceplate 30 and contact means 32 may be part of that enclosure.

In order to provide support for heater coil 24, and to space the same from frame 12, a plurality of insulated support means 34 are provided. As seen in FIG. 1, support means 34 are mounted on structural members 18. It is within the scope of the invention, however, to mount insulated support means 34 on various portions of frame 12. Such mounting may require a modification of the frame members, however, to conform with the features of structural members 18 as described in the sequel. In the event that the frame 12 is comprised of materials having dimensions differing from those of structural beams 18, it might be necessary to provide two sets of insulated supporters. Both sets are formed in accordance with the present invention, but have different dimensions to cooperate with the different dimensions of the frame and the structural beams. It is also possible, of course, that a single insulated support means may be mounted on each structural beam although three supporters are shown in the figures.

Figure 3:
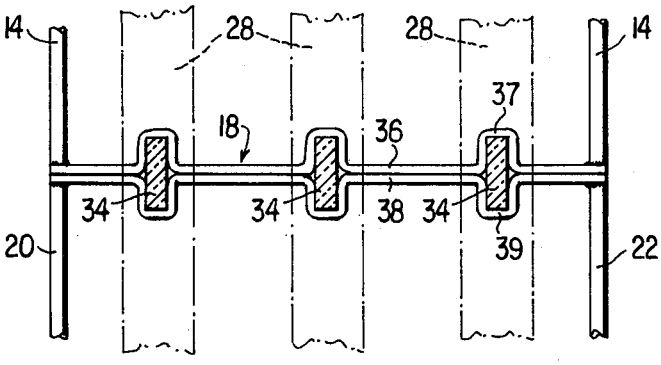
FIG. 3 is a fragmentary plan view of the heater of FIG. 2 taken along line 3—3 therein.

In accordance with the invention, structural members 18 may be formed of rods 36 and 38 as shown in FIGS. 3 and 4. As best seen in FIG. 3, the rods are bent and joined together, the bends in each rod being aligned with the other to form a cavity having a predetermined peripheral configuration for receiving support means 34. While both rods 36 and 38 are shown in the Figure as having bent portions 37 and 39, it is recognized that one rod may be straight and only one rod bent, and that a cavity may be formed by joining the straight and the bent rods together. Structural beams formed of two identical rods, each having bent portions, require no sorting of the rods, however, thus simplifying manufacture of the heater. That is, structural beams formed as shown in FIG. 3 utilize pairs of identifical rods, while beams formed of straight and bent rods require a sorting step in their fabrication to separate the dissimilar rods. It is seen that greater economy of manufacture is achieved by using the preferred structure of FIG. 3.

As shown in FIGS. 1–4, support insulators 34 are received in openings formed in beams 18. It is possible, of course, that the beams may be manufactured from components other than as shown in FIGS. 3–5, and that cavities be provided therein otherwise than as previously described.

Referring specifically to FIGS. 4–8, it is seen that insulated receiving support means 34 include a central body portion 40 having first mounting means comprising notches 42 and 44 formed therein. These notches are used to mate with rods 36 and 38, as shown in FIG. 4, thereby locking the insulators in place. Specifically, the largest cross sectional area of supporter 34, formed in central body 49 thereof, exceeds the area of the predetermined peripheral configuration formed by bent portions 37 and 39 of rods 36 and 38. The rods, or other components of beams 18, are thus caused to flex and expand slightly to accommodate the central body portion 40 during insertion of supporter 34 in the beam. The general shapes of the cavity periphery and of the cross section of supporter 34 are similar, in order to avoid the necessity for complete misshaping of the beam during insertion of the supports. When insertion has proceeded to the point of contact between rods 36 and 38 and notches 42 and 44 formed in the insulator support, the rods spring back to their original forms and mate with the notches, thus mounting the insulators on the beams. Two notches are shown in central body portion 40 for providing a tighter retention of the insulator by the beam. However, a single notch may similarly be used, at the cost of reduced retention force. Alternatively, three of four notches may also be used. Further still, the two notches shown in the shorter dimensioned parallel and oppositely disposed, longitudinally transverse sides 46 and 48 may be provided in the substantially flat front and back faces of the structure, the front face being shown at 49, having a longer dimension than the side faces.

As shown in FIG. 6, the insulated supporter of the present invention includes upper and lower coil retainers, the second mounting means, at opposite sides of the supporter, labeled 50 and 52, respectively. It is within the scope of the invention to provide insulated support means having a single coil retainer, either 50 or 52, for supporting a heater coil on only one side of the plane formed by beam structure 18. The preferred embodiment, however, incorporates two coil retainers as shown. As is seen in the figures, the insulated supporters of the present invention are completely symmetrical. That is, the supporters may be rotated about a horizontal axis of symmetry without alteration of their appearance. A similar observation may be made with respect to a vertical axis of symmetry, inasmuch as the number of orientation steps which must be performed, prior to proper insertion of a supporter in a cavity formed within the beams, is minimized thereby. Assembly may proceed after a single orientation step, in which it is determined that the width dimension of front face 49 of the insulator is transverse to the longitudinal dimension of a structural beam.

In view of the above described symmetry, the following description of the upper coil retaner 50 is not repeated for lower retainer 52. The upper retainer 50 is provided with a flat surface 54, permitting fabrication of a plurality of end-to-end connected insulators which may be severed along mating flat surfaces 54. Surface 54 may be provided with a peaked portion and with slanted surfaces sloping downwardly towards the front face 56 of the upper retainer 50. Such slanted surfaces may be used to ease insertion of the supporters into the cavities in beams 18. As is seen in the figures, however, the front face 56 is backwardly slanted from a peak 57 substantially at its center, thereby providing substantially narrower surfaces at sides 70 and 72 than at the peak 57. An advantage of the narrow sides 70 and 72 is the ease of insertion of the corners or the coil retainers into the cavities in beams 18, and the ability of prying open the cavities to accommodate the remaining portion of the insulator.

Similarly, as the notches form a first mounting means in central body 40 of the supporter, one or more notches are formed in upper coil holder 50. Notches 58 and 60 form a first set of notches in the insulated supporter, for retaining a heating coil above the plane of structural members 18. A second set of notches, shown at 59 and 61, is formed in lower coil retainer 54. Notches 59, 61 form a second mounting means.

In an alternative embodiment of the invention, support means 34 has sides 70 and 72 flush with the longitudinal ends of body portion 40. This would simplify the construction of support means 34 by eliminating side 72.

The notches forming the second mounting means are essentially parallel to the notches forming the first mounting means. Such a relationship between the notches eases fabrication of the supports. Guide means, comprising inclined surfaces 62 and 64, urge the portions of a single convolution 25, shown in FIG. 4, toward notch 58. Similar inclined surfaces 66 and 68 provide a guide means leading the coil towards notch 60. Other guiding surfaces are also provided for the lower coil retainer 52. Such inclination permits the spring-like flexibility of the heater coil to cause the turns thereof gently to return to the mounting notches in the event of a displacement therefrom. Longer horizontal portions may be provided within the notches, thus providing a more positive locking of the coil in place once inserted.

As seen further in FIG. 4, vertical side surface 70, in cooperation with inclined surface 62, forms a shoulder portion which retains coil 26 and prevents vertical transverse displacement thereof. The presence of coil retainer 50 between the portions of convolution 25 is seen to prevent longitudinal displacement of the heater coil.

As described herein, the present invention accordingly provides an insulated support means for retaining a heater coil in place. The support means are easily fabricated, preferably in intergrated form, and readily assembled in a heater structure utilizing a simplified structural beam.

The second embodiment of the invention disclosed herein can be seen in FIGS. 9–13. FIG. 9 shows a partial plan view of the structure of the second embodiment of the invention and FIG. 10 shows a partial side elevational view of the second embodiment of the invention. FIG. 9 shows a frame comprising a face plate structure 101 and a longitudinal elongated structural member 103. Means for producing electric current 107 are held in place in the face plate structure 101. A heater coil 24, hereafter electric resistance heater wire 24, is held in place along the heater and connected to means for producing electric current 107 and is supported in position by support insulators 34. Gripping means 105 holds the support insulators 34 symmetrically about the longitudinal, elongated structural member 103. The support insulators 34 support the singular electrical resistance wire 24 which loops around elongated structural member 103 and is connected on each end to a means for providing electrical current 107.

A closeup plan view of the gripping means 105 holding support insulators 34 can be seen in FIG. 11. In FIG. 11, the gripping means 105 comprises a singular piece of wire bent to substantially surround support insulators 34 having a transverse leg 109, longitudinal leg 111 and a transverse leg 113 substantially surrounding support insulator 34 with leg 109 receivably accepted in notch 42 and leg 113 accepted in notch 44 of support insulator 34. A second longitudinal leg 115 abuts against the body portion of support means 34 oppositely disposed from longitudinal leg 111 to substantially surround support means 34 with the gripping means 105. Bridge member 117 transversely crosses and is connected to longitudinal structure member 103 and secures gripping member 105 in place. Notches 58–61 function to support electrical resistance heater wire 24 by capturing adjacent loops of a coil as described above. A front elevation of support insulators 34 held in gripping means 105 can be seen in FIG. 12.

FIG. 13 shows a view of a partially bent gripping member 105 during manufacture where it can be seen that legs 109, 113, 115 and bridge members 117 are bent around a jig to proper shape. Insulator 34 is then placed with notch 42 butting against leg 113; leg 111 is then bent around insulators 34, and leg 109 is accepted in notch 44 to securely hold the insulator 34 in place.

The preferred embodiments of the invention hereinabove described are provided as illustrations, and not as limitations, of the invention. Equivalent variations of the described embodiments will occur to those skilled in the art. Such modifications, variations and equivalents are within the scope of the invention as recited with greater particularity in the following claims, when interpreted to obtain the benefits of all equivalents to which the invention is fairly entitled.

What is claimed is:

1. An electric heater comprising a heater coil attached to a base, said heater coil having a plurality of convolutions of heater wire, and an insulating support for said heater coil having a body portion cooperating with means for attaching said support to said base, a first retaining member extending from said body portion in a first direction, said first retaining member having a first dimension and a second dimension, in a plane transverse to said first direction, said first dimension being greater than the spacing between adjacent convolutions of said heater coil and said second dimension being transverse to said first dimension and smaller than said first dimension, said first retaining member having first and second notches therein, said first and second notches extending along said first dimension from an inner part of said first retaining member in opposed directions transverse to said first direction and outwardly toward respective outer surfaces of said first retaining member, and first and second guide surfaces oblique to said first direction adjacent each of said first and second notches, said first guide surface connecting an upper portion of a respective one of said first and second notches to said outer surface and said second guide surface connecting a lower portion of a respective one of said first and second notches to said outer surface, said guide surfaces cooperating to secure a single convolution of said heater coil in each of said first and second notches when said coil is at operating and non-operating temperatures and to allow easy insertion of a convolution into each of said first and second notches.

2. The electric heater of claim 1 wherein said two guide surfaces diverge from said notch toward said outer surface.

3. The electric heater of claim 2 wherein said upper portion of said notch includes a flat surface normal to said first direction and wherein one of said guide surfaces intersects said flat surface.

4. The electric heater of claim 1 or 3 wherein said means for attaching comprises:

two elongate rods, for supporting said body, at least one of said rods having a portion for being received by a groove in said body, said two rods being secured together to create a band which encircles said body.

5. An assembly as in claim 1 or 3 wherein said means for attaching further comprises:

an elongate rod having at least one bent portion which at least partially encircles said body and is received by a groove in said body.

6. An assembly as in claim 5 wherein said base comprises a plurality of elongate side members, and wherein said means for attaching extends between said side members.

7. An assembly as in claim 5 wherein said base comprises a single elongate rod.

8. The electric heater of claim 1 or 3 wherein said body portion is a rectangular parallelepiped and said first retaining member has a hexagonal cross-section with four equal sides and two facing shorter sides in said transverse plane.

9. The electric heater of claim 1 or 3 wherein said retaining member is narrower at said outer surfaces which are spaced in a direction transverse to said first direction than at a central portion.

10. The electric heater of claim 9 wherein said notches receive only a single convolution of said heater coil.

11. The electric heater of claim 1 or 3 further comprising a second retaining member extending from said body portion in a second direction opposite to said first direction, said second retaining member having a first extent and a second extent, in a plane transverse to said second direction, said first extent being greater than the spacing between adjacent convolutions of said heater coil and said second extent being transverse to and less than said first extent, said second retaining member having third and fourth notches therein, said third and fourth notches extending along said first extent from an inner part of said second retaining member in opposed directions transverse to said second direction and outwardly toward respective outer surfaces of said second retaining member, and third and fourth guide surfaces oblique to said second direction adjacent each of said third and fourth notches, said third guide surface connecting a lower portion of a respective one of said third and fourth notches to said outer surface and said fourth guide surface connecting an upper portion of a respective one of said third and fourth notches to said outer surface, said third and fourth guide surfaces cooperating to secure a single convolution of said heater coil in each of said third and fourth notches when said coil is at operating and non-operating temperatures and to allow easy insertion of a convolution into each of said third and fourth notches.

12. The electric heater of claim 11 wherein said body is a rectangular parallelepiped and each of said first and second retaining members has a hexagonal cross-section with four equal sides and two facing shorter sides in said transverse plane.

* * * * *

UNITED STATES PATENT AND TRADEMARK OFFICE

CERTIFICATE OF CORRECTION

PATENT NO. : 4,458,141

DATED : July 3, 1984

INVENTOR(S) : H. Keith Howard and Jimmy L. Sherrill

It is certified that error appears in the above-identified patent and that said Letters Patent are hereby corrected as shown below:

On the title page;

[75] Change "Skerrill" to -- Sherrill --

Signed and Sealed this

*Sixteenth* Day of *July 1985*

[SEAL]

*Attest:*

DONALD J. QUIGG

*Attesting Officer* *Acting Commissioner of Patents and Trademarks*